United States Patent [19]

Hasegawa et al.

[11] Patent Number: 4,508,088

[45] Date of Patent: Apr. 2, 1985

[54] METHOD FOR CONTROLLING FUEL SUPPLY TO AN INTERNAL COMBUSTION ENGINE AFTER TERMINATION OF FUEL CUT

[75] Inventors: Shumpei Hasegawa, Niiza; Noriyuki Kishi, Tokyo, both of Japan

[73] Assignee: Honda Giken Kogyo Kabushiki Kaisha, Tokyo, Japan

[21] Appl. No.: 523,680

[22] Filed: Aug. 16, 1983

[30] Foreign Application Priority Data

Aug. 20, 1982 [JP] Japan ..... 57-143457

[51] Int. Cl.[3] ..... F02D 5/00

[52] U.S. Cl. ..... 123/493; 123/325; 123/492; 74/860

[58] Field of Search ..... 123/493, 492, 325, 326; 74/860

[56] References Cited

U.S. PATENT DOCUMENTS

| | | | |
|---|---|---|---|
| 4,221,193 | 9/1980 | Ezoe et al. | 123/493 |
| 4,311,123 | 1/1982 | Glöckler et al. | 123/325 |
| 4,387,681 | 6/1983 | Ikeura et al. | 123/325 |

*Primary Examiner*—Andrew M. Dolinar

*Attorney, Agent, or Firm*—Lyon & Lyon

[57] ABSTRACT

A method for controlling the quantity of fuel being supplied to an internal combustion engine having a power transmission means for transmitting engine torque to vehicle wheels. The fuel quantity is controlled to required values after termination of a fuel cut operation which is effected at deceleration of the engine, by the use of increments set in synchronism with generation of pulses of a predetermined control signal. The state of engagement of the power transmission means is detected for a period of time after a transition of the operative state of the engine from the fuel cut operation to a normal operation wherein fuel supply is effected has been detected and before a predetermined number of pulses of the above predetermined control signal are generated. Among a plurality of predetermined groups of fuel increments having different fuel quantity increasing characteristics from each other, one group is selected which corresponds to the detected state of engagement of the power transmission means, to effect the above increasing of the fuel quantity by the use of the selected group of fuel increments.

6 Claims, 5 Drawing Figures

CPU
503
ROM
507
RAM
508
DRIVING CIRCUIT
509
FUEL INJECTION VALVES
6
510
ECU
A/D CONVERTER
506
5
MULTI-PLEXER
505
Me COUNTER
502
LEVEL SHIFTER UNIT
504
WAVEFORM SHAPER
501
θth SENSOR
4
PBA SENSOR
8
TW SENSOR
10
CLUTCH SW
20
NEUTRAL P. SW
21
Ne SENSOR
11

METHOD FOR CONTROLLING FUEL SUPPLY TO AN INTERNAL COMBUSTION ENGINE AFTER TERMINATION OF FUEL CUT

BACKGROUND OF THE INVENTION

This invention relates to a method for controlling the fuel supply to an internal combustion engine by means of an electronically controlled fuel injection system, and more particularly to a method for increasing the fuel supply quantity in response to the state of engagement of the power transmission means after termination of a fuel cut operation.

In conventional methods of controlling the fuel supply to an internal combustion engine in response to operating conditions of the engine by means of an electronically controlled fuel injection system, it is known to cut off the fuel supply to the engine at deceleration for improvement of the fuel consumption and emission characteristics of the engine, and then increase the quantity of fuel being supplied to the engine immediately after termination of the fuel cut operation, so as to improve the driveability of the engine. As such after-fuel cut fuel control methods, it has been proposed by Japanese Utility Model Provisional Publication No. 53-33721 to increase the fuel quantity by setting a longer fuel injection period for a predetermined period of time starting from the termination of a fuel cut operation, and it has also been proposed by Japanese Patent Provisional Publication No. 56-47631 to increase the fuel quantity by an amount corresponding to the duration of the immediately preceding fuel cut operation.

However, even if a fuel increase is effected after a fuel cut operation according to the above proposed methods, the engine speed can suddenly drop to cause engine stall, when power transmission means such as the clutch of the engine becomes disengaged to interrupt power transmission from the engine to the vehicle wheels, through the driver's operation, immediately after the termination of the fuel cut operation. Further, if the fuel increasing quantity or increment applied after termination of a fuel cut operation is set to a large value enough to avoid such engine stall, the resulting fuel supply quantity can be excessive if the power transmission means remains engaged even after termination of the fuel cut operation, which causes not only increased fuel consumption and deteriorated emission characteristics of the engine but also an acceleration shock upon transition from the fuel cut operation to a normal operation wherein fuel supply is effected.

SUMMARY OF THE INVENTION

It is the object of the invention to provide a fuel supply control method for internal combustion engines, which is adapted to set a fuel increment in dependence on the state of engagement of the power transmission means after termination of a fuel cut operation so as to avoid both engine stall and supply of an excessive quantity of fuel to the engine which can take place, respectively, when the power transmission means becomes disengaged immediately after termination of a fuel cut operation and when the same means remains engaged on such occasion, thereby improving the driveability, emission characteristics and fuel consumption of the engine.

According to the invention, there is provided a method of controlling the quantity of fuel being supplied to an internal combustion engine for a vehicle equipped with a power transmission means for transmitting torque from the engine to wheels of the vehicle, after termination of a fuel cut operation of the engine which is effected at deceleration of the engine, to desired values by increasing the fuel quantity by the use of fuel increments set in synchronism with generation of pulses of a predetermined control signal which are generated at predetermined crank angle positions of the engine. The method according to the invention is characterized by comprising the following steps: (1) setting befoehand a plurality of groups of fuel increments which have different fuel quantity increasing characteristics from each other; (2) determining whether or not there occurs a transition of the operative state of the engine from the above fuel cut operation wherein fuel supply is cut off to a normal operation wherein fuel supply is effected; (3) determining whether the above power transmission means is in a first state enabling transmission of torque from the engine to the wheels of the vehicle or in a second state disabling said transmission, for a period of time after the occurrence of the above transition has been determined and before a predetermined number of pulses of the above predetermined control signal are generated; (4) selecting one of said plurality of groups of fuel increments corresponding to the determined state of the power transmission means; and (5) effecting the above increasing of the fuel quantity by the use of the selected group of fuel increments.

For example, the above plurality of groups of fuel increments comprise a first group of fuel increments, and a second group of fuel increments having a fuel quantity increasing characteristic such as causes the increasing of the fuel quantity to a smaller degree than the first group of fuel increments. Preferably, the first group of fuel increments is selected when it is determined in the above step (3) that the power transmission means is in the above second state.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
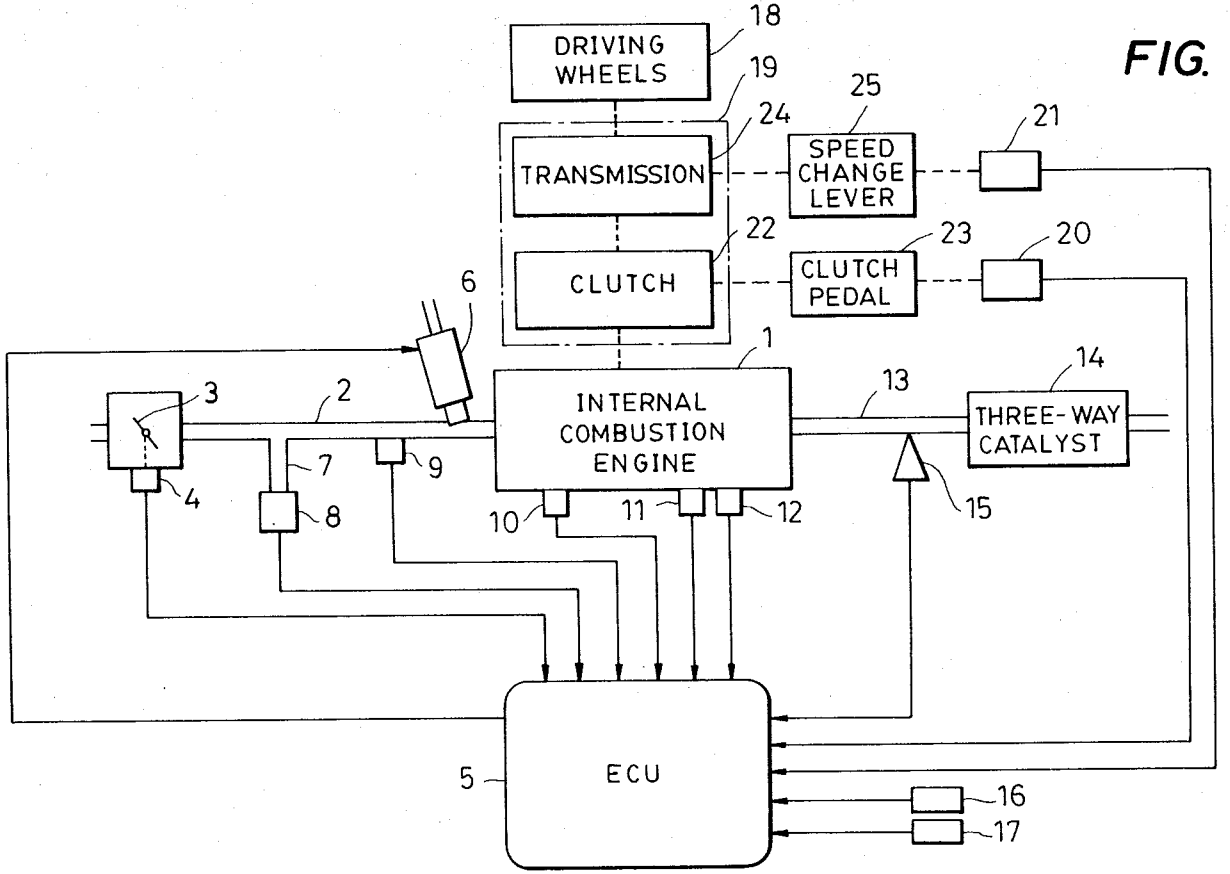
FIG. 1 is a block diagram of the whole arrangement of a fuel supply control system to which is applicable the method according to the invention.

Referring first to FIG. 1, there is illustrated the whole arrangement of a fuel supply control system for internal combustion engines, to which the method according to the invention is applicable. Reference numeral 1 designates an internal combustion engine which may be a four-cylinder type, for instance. An intake pipe 2 is connected to the engine 1, in which is arranged a throttle valve 3 which in turn is coupled to a throttle valve opening sensor ($\theta$th sensor) 4 for detecting its valve opening and converting same into an electrical signal which is supplied to an electronic control unit (hereinafter called "the ECU") 5.

Fuel injection valves 6 are arranged in the intake pipe 2 at a location between the engine 1 and the throttle valve 3, which correspond in number to the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure sensor (PBA sensor) 8 communicates through a conduit 7 with the interior of the intake pipe at a location immediately downstream of the throttle valve 3. The absolute pressure sensor 8 is adapted to detect absolute pressure in the intake pipe 2 and applies an electrical signal indicative of detected absolute pressure to the ECU 5. An intake air temperature sensor 9 is arranged in the intake pipe 2 at a location downstream of the absolute pressure sensor 8 and also electrically connected to the ECU 5 for supplying same with an electrical signal indicative of detected intake air temperature.

An engine temperature sensor (Tw sensor) 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rotational speed sensor (hereinafter called "the Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the engine starter, not shown, of the engine 1 for supplying an electrical signal indicative of detected atmospheric pressure and an electrical signal indicative of its own on and off positions to the ECU 5, respectively.

Still further connected to the ECU 5 are a clutch switch 20 and a neutral position switch 21 for detecting the state of engagement of a power transmission system 19 mounted on the engine for transmitting torque produced by the engine to driving wheels 18 of an associated vehicle. The clutch switch 21 is mechanically or electrically connected to a clutch pedal 23 for causing engagement and disengagement of a clutch 22 forming part of the power transmission system 19, to detect the state of engagement of the clutch 22 and supply an electrical signal indicative of a detected position of the clutch 22 to the ECU 5. The neutral position switch 21 is mechanically or electrically connected to a speed change lever 25, to detect whether or not the speed change lever 25 is in its neutral position, that is, whether a transmission 24 which forms part of the transmission system 19 and is operated by the speed change lever 25 is in an engaged position wherein power transmission is effected by the transmission 24 and in a disengaged position wherein the power transmission is interrupted. The neutral position switch 21 supplies an electrical signal indicative of a detected position of the speed change lever 25 to the ECU 5.

The ECU 5 operates in response to various engine operation parameter signals as stated above, to determine operating conditions in which the engine is operating, such as a fuel cut operating region, etc. and to calculate the fuel injection period TOUT of the fuel injection valves 6, which is given by the following equation, in accordance with the determined operating conditions of the engine:

$$TOUT = Ti \times K_1 + K_2 \quad (1)$$

where Ti represents a basic value of the fuel injection period of the fuel injection valves 6, which is determined by engine rpm Ne and intake pipe absolute pressure PBA, and $K_1$ and $K_2$ correction coefficients and correction variables which are calculated on the basis of values of various engine operation parameter signals from the aforementiond various sensors, that is, the throttle valve opening sensor 4, the intake pipe absolute pressure sensor 8, the intake air temperature sensor 9, the engine cooling water temperature sensor 10, the Ne sensor 11, the cylinder-discriminating sensor 12, the $O_2$ sensor 15, the atmospheric pressure sensor 16 and the starter switch 17, as well as signals indicative of the state of engagement of the power transmission system 19 from the clutch switch 20 and the neutral position switch 21. These correction coefficients $K_1$ and correction variables $K_2$ are calculated, by the use of respective predetermined equations, etc. to such values as to optimize various operating characteristics of the engine such as startability, emission characteristics, fuel consumption and accelerability.

The ECU 5 operates on the fuel injection period TOUT determined as above to supply the fuel injection valves 6 with driving signals for opening same.

Figure 2:
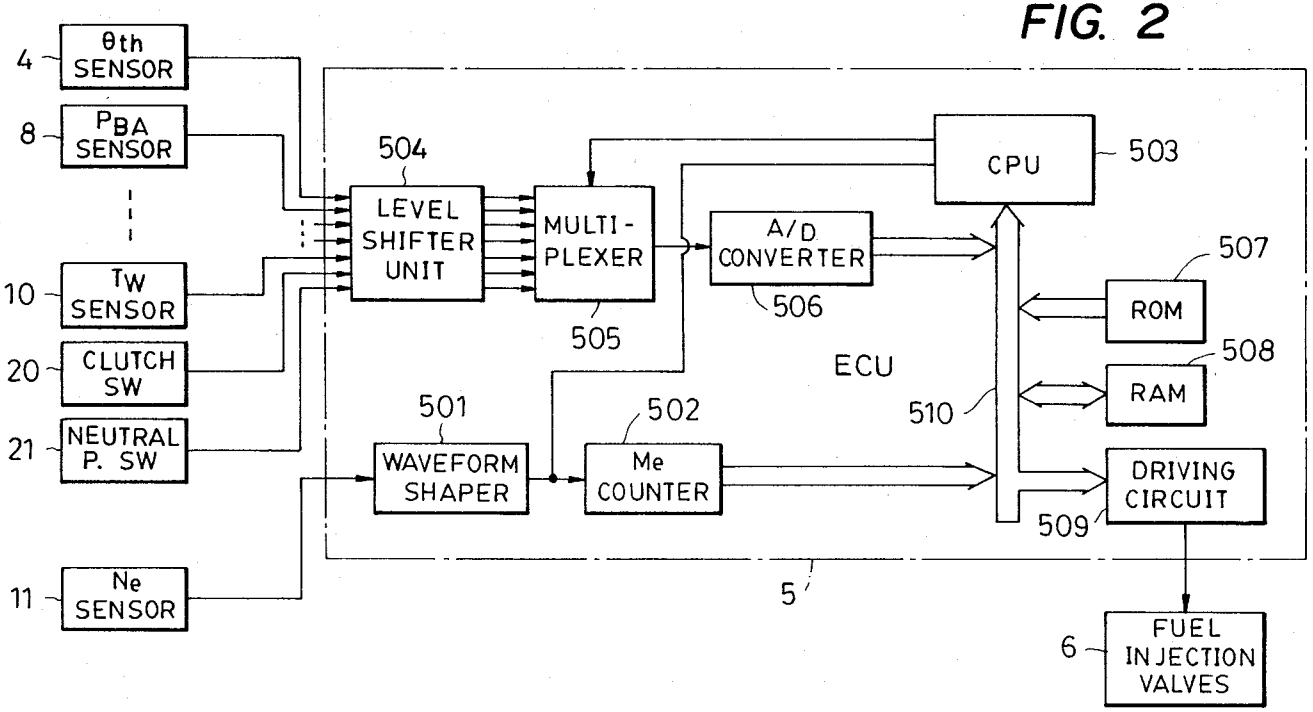
FIG. 2 is a block diagram of the internal arrangement of an electronic control unit appearing in FIG. 1.

FIG. 2 shows a circuit configuration within the ECU 5 in FIG. 1. An output signal from the Ne sensor 11 in FIG. 1 is applied to a waveform shaper 501, wherein it has its pulse waveform shaped, and supplied to a central processing unit (hereinafter called "the CPU") 503, as the TDC signal, as well as to have an Me value counter 502. The Me value counter 502 counts the interval of time between a preceding pulse of the TDC signal generated at a predetermined crank angle of the engine and a present pulse of the same signal generated at the same crank angle, inputted thereto from the Ne sensor 11, and therefore its counted value Me corresponds to the reciprocal of the actual engine rpm Ne. The Me value counter 502 supplies the counted value Me to the CPU 503 via a data bus 510.

The respective output signals from the throttle valve opening sensor 4, the intake pipe absolute pressure (PBA) sensor 8, the engine coolant temperature sensor 10, the clutch switch 20, the neutral position switch 21, etc. have their voltage levels successively shifted to a predetermined voltage level by a level shifter unit 504 and successively applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called 37 the ROM") 507, a random access memory (hereinafter called "the RAM") 508 and a driving circuit 509. The RAM 508 temporarily stores various calculated values and data indicative of the state of engagement of the power transmission system 19 from the CPU 503, while the ROM 507 stores a control program to be executed within the CPU 503 as well as maps of values of the basic fuel injection period Ti for the fuel injection valves 6, predetermined values of engine operation parameters such as engine rpm Ne and intake pipe absolute pressure PBA for determining the fuel cut effecting region of the engine, first and second tables of values of an after-fuel cut fuel cut increasing coefficient KAFC, hereinafter referred to, etc. The CPU 503 executes the control program stored in the ROM 507 in synchronism with generation of pulses of the TDC signal to calculate the fuel injection period TOUT for the fuel injection valves 6 in response to values of the various engine operation parameter signals and signals indicative of the state of engagement of the power transmission system 19, and supplies the calculated value of fuel injection period TOUT to the driving circuit 509 through the data bus 510. The driving circuit 509 supplies driving signals corresponding to the above calculated TOUT value to the fuel injection valves 6 to drive same.

Figure 3:
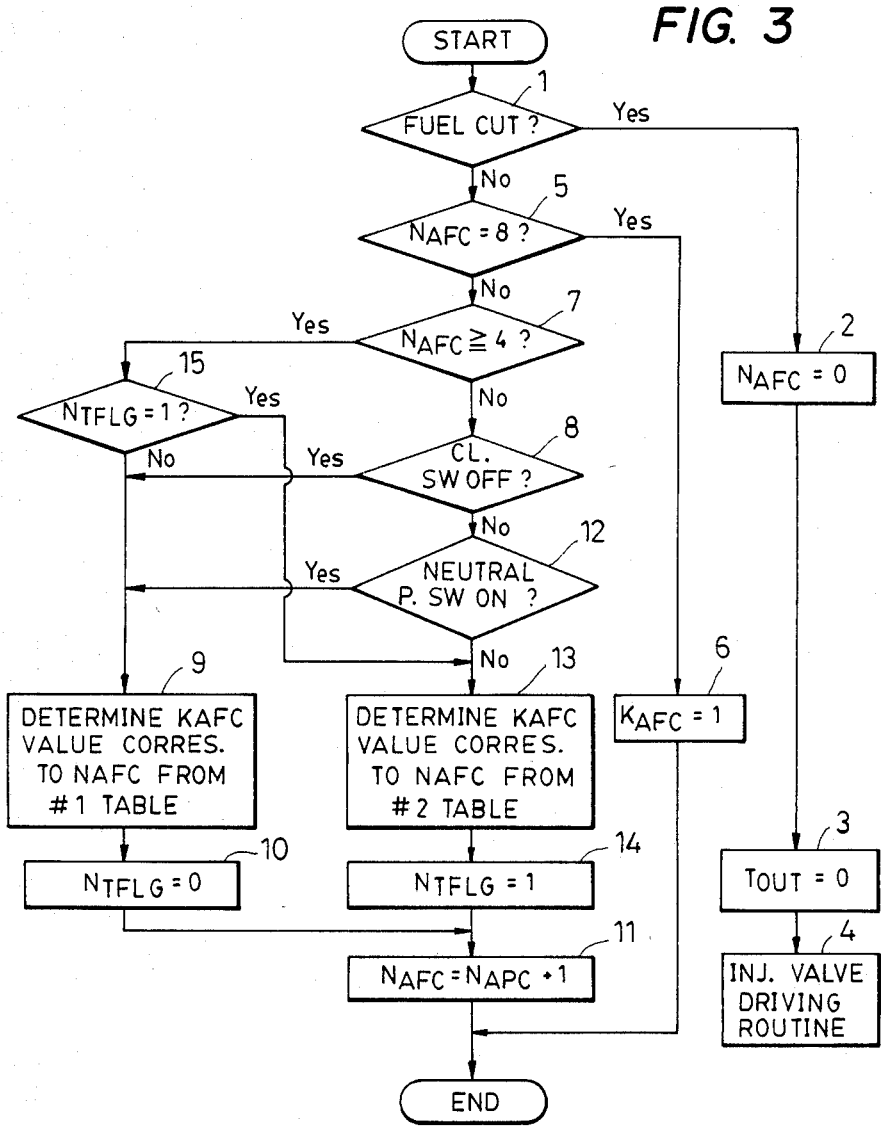
FIG. 3 is a flow chart showing a manner of determining the value of an after-fuel cut fuel increasing coefficient KAFC according to the method of the invention.

FIG. 3 is a flow chart of a manner of determining the value of the after-fuel cut fuel increasing coefficient KAFC according to the method of the invention, which forms a subroutine of the aforementioned control program. According to the invention, at an instant immediately following the termination of a fuel cut operation, the fuel supply to the engine is controlled in response to the state of fuel supply to the individual engine cylinders as well as the state of engagement of the power transmission system 19. More specifically, first at the step 1, a determination as to whether or not the engine is operating in a predetermined operating condition wherein the fuel supply is to be cut off is made by comparison of values of engine operation parameter signals such as engine rpm Ne and intake pipe absolute pressure PBA with respective predetermined fuel cut determining values. If the answer is yes, the value of a control variable NAFC which represents the number of pulses of the TDC signal supplied to the ECU 5 and stored therein after termination of a previous fuel cut operation is reset to 0, at the step 2. In other words, the value of the control variable NAFC represents the number of engine cylinders which have been supplied with fuel after termination of a fuel cut operation, and forms a parameter for determining the value of the fuel increasing coefficient KAFC. Following the execution of the step 2, the value of the fuel injection period TOUT is reset to 0 at the step 3, to render the fuel injection valves 6 inoperative at the step 4, thereby effecting a fuel cut operation.

Figure 4:
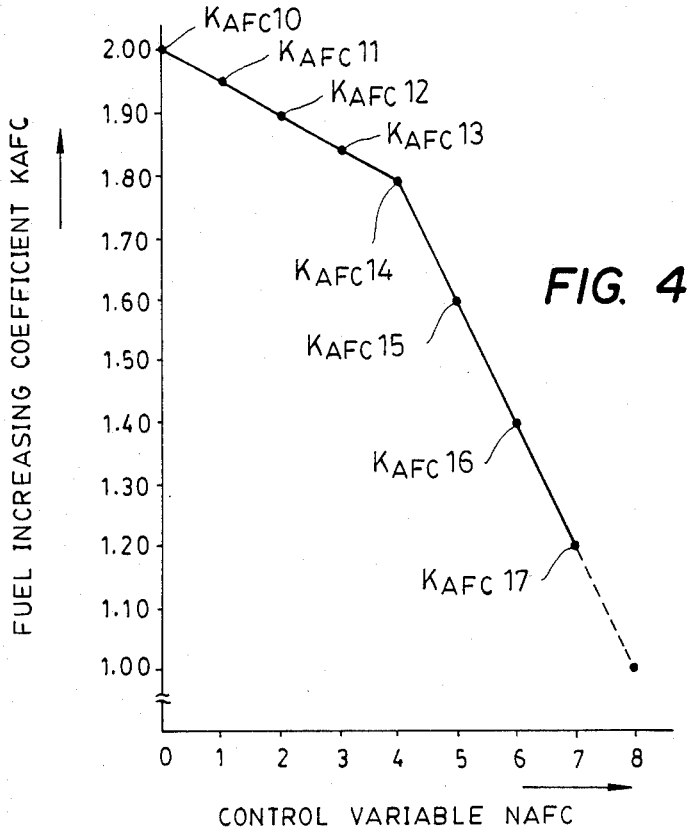
FIG. 4 is a graph showing, by way of example, a first table of values of the fuel increasing coefficient KAFC in FIG. 3 plotted with respect to values of a control variable NAFC.

On the other hand, if it is determined that the fuel cut effecting condition is not fulfilled or the answer is no at the step 1, it is determined whether or not the quantity of fuel to be supplied to the engine should be increased as well as how much the fuel quantity should be increased, at the step 5 et seq. First, it is determined at the step 5 whether or not the value of the control variable NAFC indicative of pulses of the TDC signal inputted to the ECU after termination of an immediately preceding fuel cut operation has reached a predetermined value, e.g. 8. This predetermined value is set at a value corresponding to a required number of times of injection of increased quantities of fuel into the engine so as to improve the driveability, etc. of the engine immediately after termination of a fuel cut operation. If the predetermined value is set at 8, each of the cylinders of the engine will be supplied with an increased quantity of fuel twice after termination of a fuel cut operation. If the answer to the question of the step 5 is yes, that is, if the engine cylinders have been supplied with an increased quantity of fuel the above predetermined number of times or eight times, the value of the after-fuel cut coefficient KAFC is set to 1 at the step 6 to terminate the after-fuel cut increase of the fuel quantity, thereby terminating the execution of the present subroutine. If the answer to the question of the step 5 is no, that is, if the engine cylinders have not yet been supplied with an increased quantity of fuel the predetermined number of times, it is determined at the step 7 whether or not the value of the control variable NAFC is larger than the number of the engine cylinders, i.e. 4 in the present embodiment, that is, whether or not each of the engine cylinders has been supplied with an increased quantity of fuel one time after the termination of the fuel cut operation. Part of fuel in a first batch being supplied to each of the engine cylinders after termination of a fuel cut operation is consumed to wet the inner wall of the intake pipe. Therefore, at a time before at least first batches of fuel are supplied to all the engine cylinders after termination of a fuel cut operation, if the power transmission system becomes disengaged, there can occur a sudden drop in the rotational speed of the engine, and even engine stall. According to the invention, the value of the after-fuel cut fuel increasing coefficient KAFC is determined in dependence on the results of the determination of the step 7 so as to avoid the above-mentioned inconvenience, as hereinafter described. If the answer to the question of the step 7 is no, that is, if the value of the control variable NAFC is any of 0 to 3 when all the cylinders have not been supplied with first batches of fuel, it is determined at the step 8 whether or not the clutch switch 20 is in an off position. If the answer is yes, that is, if the clutch 22 forming part of the power transmission system 19 is in a disengaged state, a value of a first coefficient KAFC1 is selected from a first table of values of the fuel increasing coefficient KAFC, which corresponds to the value of the control variable NAFC indicative of pulses of the TDC signal inputted after the termination of the fuel cut operation, at the step 9. The first table is designed to provide a first fuel quantity increasing characteristic for application in the event of disengagement of the power transmission system 19 immediately after transition from a fuel cut operation to a normal fuel-supplied operation. This first fuel quantity increasing characteristic is set to increase the fuel quantity at a large rate so as to assure avoidance of engine stall caused by a sudden and drastic drop in the engine rotational speed in the event of disengagement of the power transmission system immediately after termination of a fuel cut operation. That is, the first fuel increasing coefficient KAFC1 is set at larger values than values required in the event of engagement of the power transmission system 19. As shown in FIG. 4 showing the first table, the first fuel increasing coefficient KAFC1 comprises a group of coefficient values KAFC10 to KAFC17 corresponding, respectively, to different values (0, 1, 2, . . . 7) of the control variable NAFC (the last figures 0–7 represent the values of the control variable NAFC). When the control variable NAFC assumes 0, that is, no pulse of the TDC signal has been inputted to the ECU 5 as yet after termination of a fuel cut operation, the first coefficient KAFC1 assumes a maximum value KAFC10 (=2.00). Thereafter, as the value of the control variable NAFC increases, the first coefficient KAFC1 decreases in value correspondingly from KAFC11 to KAFC16, and when the control variable NAFC reaches a value of 7, the first coefficient KAFC1 assumes a minimum value KAFC17 (=1.20). Supply of an excessive quantity of fuel can be avoided by thus decreasing the value of the first coefficient KAFC1 with the increase of the value of the control variable NAFC.

Then, the flag signal NTFLG is set to 0 at the step 10 to indicate that an increase in the fuel supply quantity has been effected by the use of a value of the first coefficient KAFC1 selected at the step 9 or any one of the coefficient values KAFC10-KAFC17, and 1 is added to the value of the control variable NAFC at the step 11 to count the number of times of execution of the present subroutine or the number of times of supplies of fuel to the engine after termination of the last fuel operation.

Figure 5:
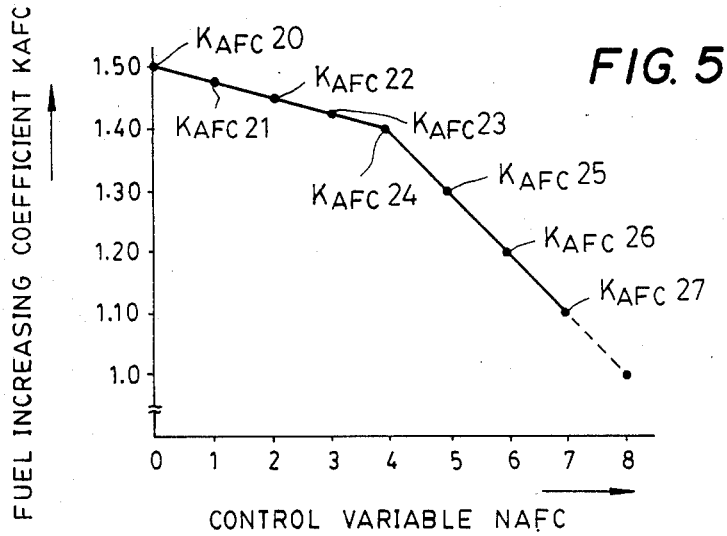
FIG. 5 is a graph showing, by way of example, a second table of values of the fuel increasing coefficient KAFC plotted with respect to values of the control variable.

On the other hand, if the answer to the question of the step 8 is no, that is, if the clutch 22 is in an engaged state, it is determined at the step 12 whether or not the neutral position switch 21 is in an on position. If the answer is yes, that is, if the transmission 24 of the power transmission system 19 is in its neutral position, the above steps 9–11 are executed, since the power transmission system 19 is then not in the power-transmissible state. If the answer to the steps 8 and 12 are both negative, that is, if the clutch 22 and the transmission 24 are not in the disengaged position and in the netral position, respectively, whereby power transmission is possible, a value of a second fuel increasing coefficient KAFC2 is selected from a second table of values of the after-fuel cut fuel increasing coefficient KAFC, which corresponds to the value of the control variable NAFC indicative of the number of pulses of the TDC signal inputted to the ECU after termination of the last fuel cut operation, at the step 13. The second table is designed to provide a second fuel quantity increasing characteristic for application in the event of engagement of the power transmission system 19 immediately after transition from a fuel cut operation to a normal fuel-supplied operation. This second fuel quantity increasing characteristic is set to increase the fuel quantity so as to assure avoidance of deterioration of the emission characteristics and avoidance of increase of the fuel consumption as well as shocks upon the transition to the normal fuel-supplied operation, while improving the driveability of the engine. As shown in FIG. 5 showing the second table, the second fuel increasing coefficient KAFC2 comprises a group of coefficient values KAFC20 to KAFC27 corresponding, respectively, to different values (0, 1, 2, . . . 7) of the control variable NAFC (the last figures 0–7 represent the values of the control variable NAFC). When the control variable NAFC assumes 0, the second coefficient KAFC2 assumes a maximum value KAFC20 (=1.50). Thereafter, as the value of the control variable NAFC increases, the second coefficient KAFC2 decreases in value correspondingly from KAFC21 to KAFC26, and when the control variable NAFC reaches a value of 7, the second coefficient KAFC2 assumes a minimum value KAFC27 (=1.10). To provide the second fuel quantity characteristic, the coefficient values KAFC20 to KAFC27 are set at smaller values as compared with corresponding ones of the coefficient values KAFC10 to KAFC17 of the first table. At the step 14, the flag signal NTFLG is set to 1 to indicate that an increase in the fuel supply quantity has been effected by the use of the second fuel increasing KAFC2, and 1 is added to the value of the control variable NAFC at the step 11 to thereby count the number of times of supplies of fuel to the engine after termination of the last fuel cut operation.

If the answer to the question of the step 7 is yes, that is, if the control variable NAFC assumes a value larger than a second predetermined value (4 in the present embodiment), indicating that all the cylinders have each been supplied with at least one batch of fuel after termination of the last fuel cut operation, it is determined whether or not the flag signal NTFLG assumes a value of 1, at the step 15. This step 15 is provided to determine which of the step 9 and the step 13 has been executed to effect increase of the fuel supply quantity when the control variable NAFC reaches a first predetermined value (3 in the present embodiment), that is, when all the engine cylinders have each been supplied with a first batch of fuel after termination of a fuel cut operation. If the answer to the question of the step 15 is yes, the program proceeds to the step 13, while if the answer is no, the program proceeds to the step 9. That is, when the control variable NAFC assumes any of 4–7, the fuel quantity increasing characteristic of the fuel increasing coefficient KAFC is continuously employed which has been selected when the control variable NAFC assumes a value of 3. This is because little fuel is consumed to wet the inner wall of the intake passage of the engine after all the engine cylinders have been supplied with fuel after termination of a fuel cut operation, and accordingly on such occasion there is no longer required a high degree of dependence on the state of engagement of the power transmission system 19 for determination of the value of the fuel increasing coefficient KAFC, and changeover between the two fuel quantity increasing characteristics will cause undesired fluctuations in the fuel supply quantity.

Incidentally, when the control variable NAFC reaches the predetermined value of 8, the execution of the present subroutine is terminated without executing the step 11. Therefore, once the predetermined value of 8 has been reached, the stored value of the control variable NAFC is held at 8 irrespective of inputting of further pulses of the TDC signal to the ECU 5. Therefore, until the fuel cut effecting condition is again fulfilled so that the control variable is set to 0 at the step 2, the program goes through the loop formed by the step 1, 5 and 6, and accordingly the value of the coefficient KAFC is held at 1, thus prohibiting execution of increasing correction of the fuel supply quantity.

What is claimed is:

1. A method of controlling the quantity of fuel being supplied to an internal combustion engine for a vehicle having wheels and a power transmission means for transmitting torque from said engine to said wheels of said vehicle, after termination of a fuel cut operation of said engine which is effected at deceleration of said engine, to desired values by increasing the fuel quantity by the use of fuel increments set in synchronism with generation of pulses of a predetermined control signal which are generated at predetermined crank angle positions of said engine, the method comprising the steps of: (1) setting beforehand a plurality of groups of fuel increments which have different fuel quantity increasing characteristics from each other; (2) determining whether or not there occurs a transition of the operative state of said engine from said fuel cut operation wherein fuel supply is cut off to a normal operation wherein fuel supply is effected; (3) determining whether said power transmission means is in a first state enabling transmission of torque from said engine to said wheels of said vehicle or in a second state disabling said transmission, for a period of time after the occurrence of said transition has been determined and before a predetermined number of said pulses of said predetermined control signal are generated; (4) selecting one of said plurality of groups of fuel increments corresponding to a state of said power transmission means determined in said step (3); and (5) effecting said increasing of the fuel quantity by the use of the selected group of fuel increments.

2. A method as claimed in claim 1, wherein said plurality of groups of fuel increments comprise a first group of fuel increments, and a second group of fuel increments having a fuel quantity increasing characteristic such as causes said increasing of the fuel quantity to a smaller degree than said first group of fuel increments, said first group of fuel increments being selected when it is determined in said step (3) that said power transmission means is in said second state.

3. A method as claimed in claim 1, wherein said engine has a plurality of cylinders, the method further including the step of successively supplying fuel into each different one of said cylinders in synchronism with generation of each pulse of said predetermined control signal, said predetermined number of pulses of said predetermined control signal being equal to the number of said cylinders.

4. A method as claimed in claim 1, wherein said power transmission means comprises a clutch and a transmission, said determination of said step (3) being executed by determining whether or not at least one of said clutch and said transmission is in an engaged state.

5. A method as claimed in claim 1, further including the steps of determining whether or not a second predetermined number of pulses of said predetermined control signal which is larger than said first-mentioned predetermined number have been generated after said determination of the occurrence of said transition, and after generation of said second predetermined number of pulses has been determined, effecting said increasing of the fuel quantity by the use of one of said groups of fuel increments which is selected at the time of generation of a pulse of said predetermined control signal immediately preceding said determination of generation of said second predetermined number of pulses.

6. A method as claimed in claim 1, wherein each of said plurality of groups of fuel increments has gradually decreasing values applied to said increasing of the fuel quantity as pulses of said predetermined control signal are successively generated.

* * * * *